US008983337B2

(12) United States Patent
Kobayashi

(10) Patent No.: US 8,983,337 B2
(45) Date of Patent: Mar. 17, 2015

(54) IMAGE FORMING APPARATUS

(71) Applicant: KYOCERA Document Solutions Inc., Osaka (JP)

(72) Inventor: Tatsuya Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/227,463

(22) Filed: Mar. 27, 2014

(65) Prior Publication Data

US 2014/0294440 A1 Oct. 2, 2014

(30) Foreign Application Priority Data

Mar. 28, 2013 (JP) ..... 2013-068842

(51) Int. Cl.

| | |
|---|---|
| ***G03G 15/04*** | (2006.01) |
| ***G03G 21/16*** | (2006.01) |
| ***G03G 15/08*** | (2006.01) |
| ***G03G 21/18*** | (2006.01) |

(52) U.S. Cl.

CPC ..... *G03G 21/1676* (2013.01); *G03G 15/0813* (2013.01); *G03G 21/1821* (2013.01)

USPC ..... 399/119

(58) Field of Classification Search

CPC ..... G03G 21/1676; G03G 21/1647; G03G 15/0896; G03G 21/1821

See application file for complete search history.

(56) References Cited

U.S. PATENT DOCUMENTS

| | | | | |
|---|---|---|---|---|
| 4,989,037 | A | 1/1991 | Nagatsuna | |
| 5,268,718 | A | 12/1993 | Maeda et al. | |
| 6,934,489 | B2 | 8/2005 | Yokomori et al. | |
| 7,039,339 | B2 | 5/2006 | Yokomori et al. | |
| 2003/0161654 | A1 | 8/2003 | Yokomori et al. | |
| 2005/0063733 | A1 | 3/2005 | Jeon | |
| 2005/0220485 | A1 | 10/2005 | Yokomori et al. | |
| 2008/0138107 | A1 | 6/2008 | Mori et al. | |
| 2008/0240774 | A1 | 10/2008 | Fukamachi et al. | |
| 2013/0195516 | A1 * | 8/2013 | Okoshi et al. | 399/279 |

FOREIGN PATENT DOCUMENTS

| | | | |
|---|---|---|---|
| EP | 1336905 | A2 | 8/2003 |
| JP | 2004-026519 | A | 1/2004 |

OTHER PUBLICATIONS

The extended European search report issued by the European Patent Office on Jul. 25, 2014, which corresponds to European Patent Application No. 14161429.7-1560 and is related to U.S. Appl. No. 14/227,463.

* cited by examiner

*Primary Examiner* — Clayton E Laballe
*Assistant Examiner* — Frederick Wenderoth
(74) *Attorney, Agent, or Firm* — Studebaker & Brackett PC

(57) ABSTRACT

An image forming apparatus includes a drive unit, an image bearing member, a developing unit, a support unit, an urging member, and a switching mechanism. The urging member generates an urging force for pivoting the support unit in an approaching direction in which a peripheral surface of a developing roller is moved toward a peripheral surface of the image bearing member. The switching mechanism switches the support unit between a first position (fitting position) and a second position (releasing position). The support unit includes: a second drive input section disposed coaxially with a pivot shaft and for receiving a rotational drive force from a drive output shaft of the drive unit; and a transmission mechanism for transmitting the rotational drive force to a first drive input section. The rotation direction of the rotational drive force is for rotation in a direction of pivoting the support unit in the approaching direction.

9 Claims, 11 Drawing Sheets

IMAGE FORMING APPARATUS

INCORPORATION BY REFERENCE

The present application claims priority under 35 U.S.C. §119 to Japanese Patent Application No. 2013-068842, filed Mar. 28, 2013. The contents of this application are incorporated herein by reference in their entirety.

BACKGROUND

The present disclosure relates to image forming apparatuses provided with a mechanism for moving a developing roller closer to and away from an image bearing member.

Some image forming apparatuses (for example, printers and copiers) include a photosensitive drum (image bearing member) and a developing unit. In addition, a gap roller is provided near each axial edge of a developing roller. The photosensitive drum bears a toner image on its peripheral surface. The developing unit includes the developing roller. The developing roller supplies toner to the photosensitive drum. In the printing operation, the photosensitive drum and the developing roller are brought into the state where the respective peripheral surfaces are opposed to each other with a predetermined gap therebetween (the state where each gap roller abuts against a non-image forming region of the peripheral surface of the photosensitive drum). In for example maintenance or jam-handling, on the other hand, when the developing unit is pulled out of the main body of the apparatus, the photosensitive drum and the developing roller are brought into the state where the respective peripheral surfaces are away from each other so as not to damage the peripheral surfaces.

For example, an image forming apparatus is suggested that includes a pressure member to bring the peripheral surface of the developing roller closer to the peripheral surface of the photosensitive drum. The developing unit is disposed to be horizontally movable within the main body. The developing unit is provided with a pin member on a side wall thereof. The pin member is guided by a horizontally elongated slot. The developing unit is urged in a horizontal direction by the pressure member. The pressure member presses the peripheral surface of the developing roller toward the peripheral surface of the photosensitive drum. Upon release of the pressure exerted by the pressure member, the developing roller moves away from the photosensitive drum.

SUMMARY

An image forming apparatus according to one aspect of the present disclosure includes a main housing, a drive unit, an image bearing member, a developing unit, a support unit, an urging member, and a switching mechanism. The drive unit has a drive output shaft that generates a rotational drive force for axial rotation. The image bearing member is disposed in the main housing and has a peripheral surface for bearing a toner image. The developing unit is attached to the main housing to be detachable by pulling out. The developing unit includes: a developing roller that has a peripheral surface for carrying toner thereon and that supplies the toner to the image bearing member; and a first drive input section that supplies a rotational drive force to the developing roller. The support unit is supported by the main housing to be freely pivotable about an axis of a pivot shaft and places and supports the developing unit in position. The urging member generates an urging force for urging the support unit to pivot in one of pivoting directions about the pivot shaft. The one pivoting direction coincides with an approaching direction for moving the peripheral surface of the developing roller toward the peripheral surface of the image bearing member. The switching mechanism switches the position of the support unit supporting the developing unit. The switching is made between a first position in which the peripheral surface of the developing roller is located relatively close to the peripheral surface of the image bearing member and a second position in which the peripheral surface of the developing roller is located relatively away from the peripheral surface of the image bearing member. The support unit includes: a second drive input section that is disposed coaxially with the pivot shaft and that receives a rotational drive force from the drive output shaft; and a transmission mechanism that transmits the rotational drive force received by the second drive input section to the first drive input section. The rotational drive force generated by the drive output shaft is for rotation in a direction of pivoting the support unit in the approaching direction.

DETAILED DESCRIPTION

The following describes an embodiment of the present disclosure with reference to the accompanying drawings. In each figure, the Z1 direction corresponds to "up", Z2 to "down", Y1 to "rear", Y2 to "front", X1 to "right", and X2 to "left".

Figure 1:
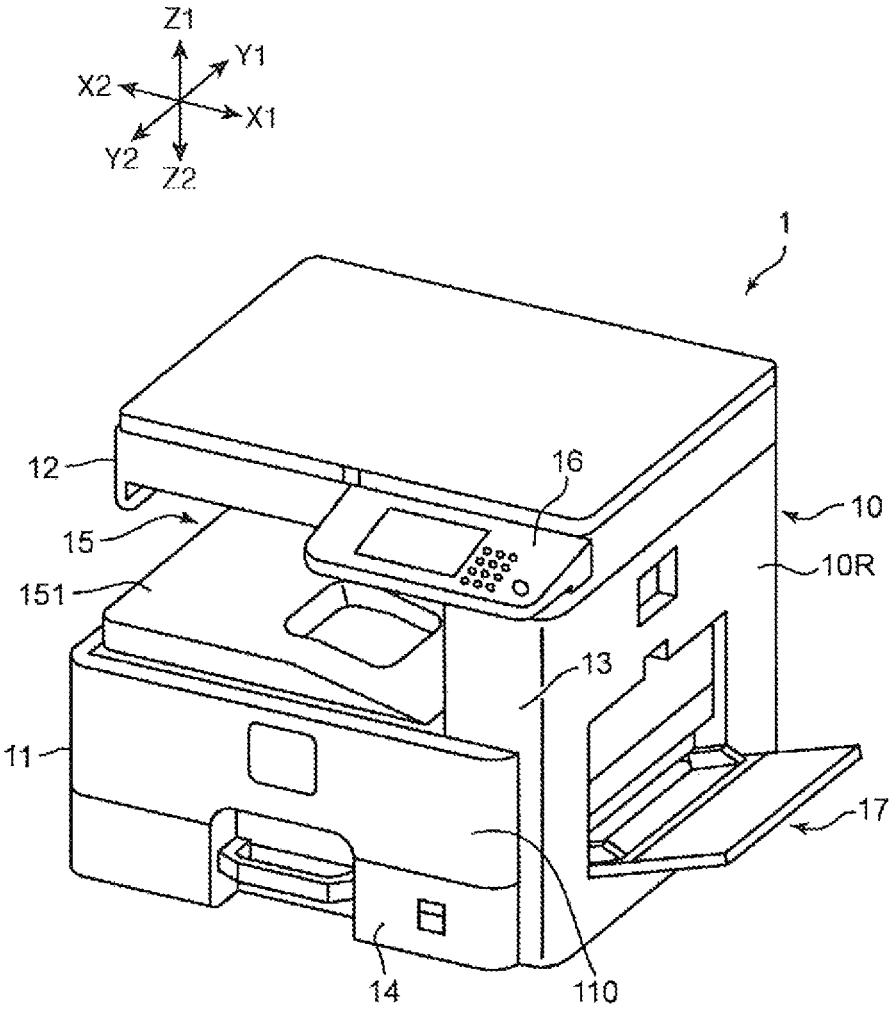
FIG. 1 is a perspective view of an appearance of an image forming apparatus according to an embodiment of the present disclosure.

First, with reference to FIG. 1, the following describes a schematic configuration of an image forming apparatus 1 according to the embodiment of the present disclosure. FIG. 1 is a perspective view of an appearance of the image forming apparatus 1 according to the embodiment of the present disclosure.

The image forming apparatus 1 is a monochrome or color printer having a copier function, for example. The image forming apparatus 1 includes a main housing 10 (the housing of the main body) having a boxlike shape. The main housing 10 includes a lower housing 11, an upper housing 12 disposed above the lower housing 11, a connecting housing 13 disposed between the lower housing 11 and the upper housing 12. The connecting housing 13 constitutes a right face 10R of the main housing 10.

The lower housing 11 accommodates various units used for performing image forming processing on a sheet. The upper housing 12 accommodates a scanner that optically reads an image of an original document sheet. The scanner operates when the image forming apparatus 1 functions as a copier.

A front cover 110 covers the front face of the lower housing 11. A sheet cassette 14 is disposed below the lower housing 11 to be freely detachable. The sheet cassette 14 stores a stack of sheets which are to be subjected to image forming processing.

The main housing 10 has an in-body paper ejection space 15. The in-body paper ejection space 15 is a space surrounded by the upper face of the lower housing 11, the lower face of the upper housing 12, and the left face of the connecting housing 13. Sheets having gone through image forming processing are ejected to the in-body paper ejection space 15. The in-body paper ejection space 15 is provided at the bottom with an in-body paper ejection tray 151 for receiving sheets.

An operation panel 16 is attached to the front face of the upper housing 12. The operation panel 16 receives user operation information input to the image forming apparatus 1.

On the right face 10R of the main housing 10, a manual feed tray 17 is provided for manually feeding a sheet. The manual feed tray 17 can be freely opened and closed relative to the right face 10R.

Figure 2:
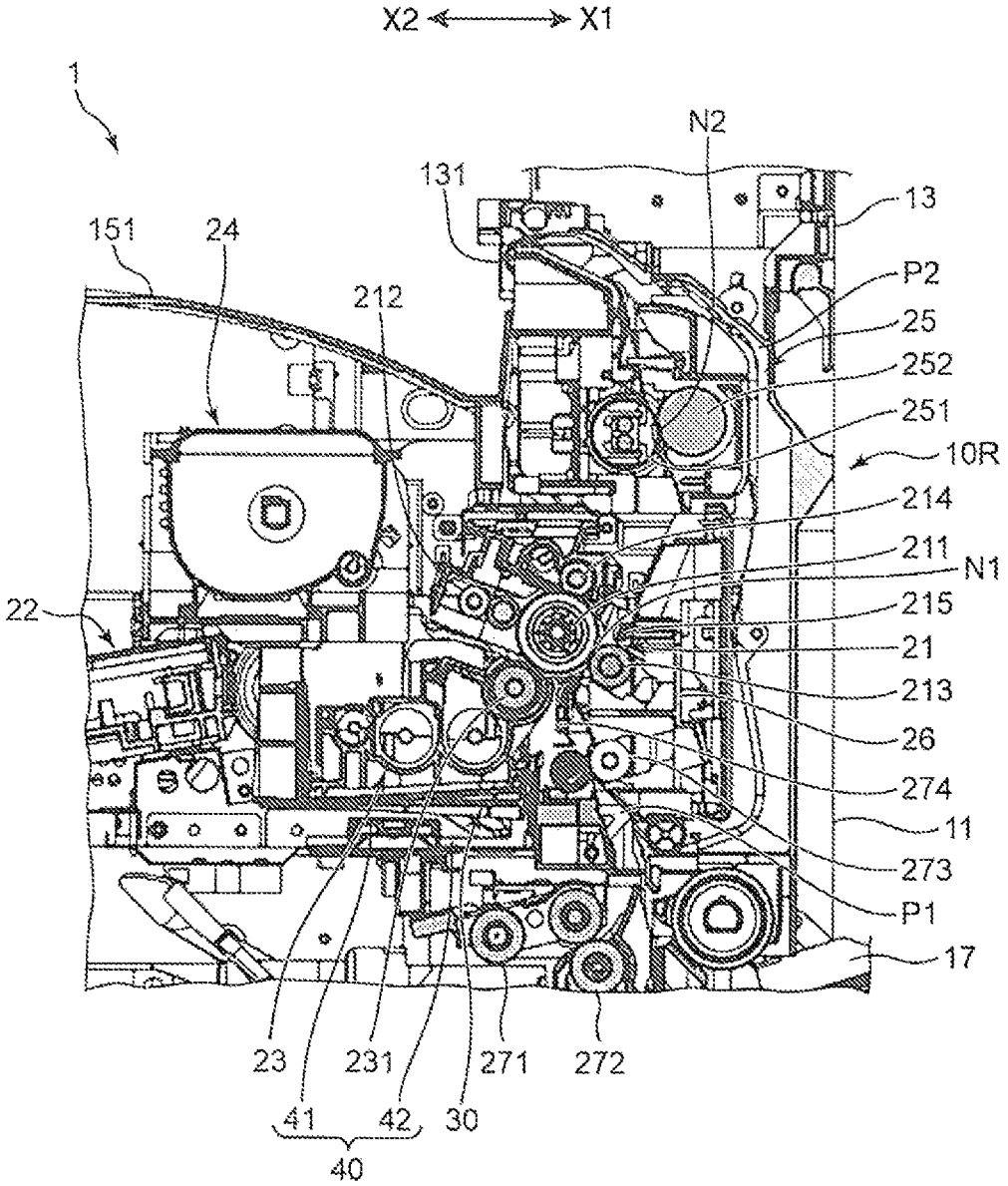
FIG. 2 is a cross sectional view of an internal configuration of the image forming apparatus according to the embodiment of the present disclosure.
Figure 3:
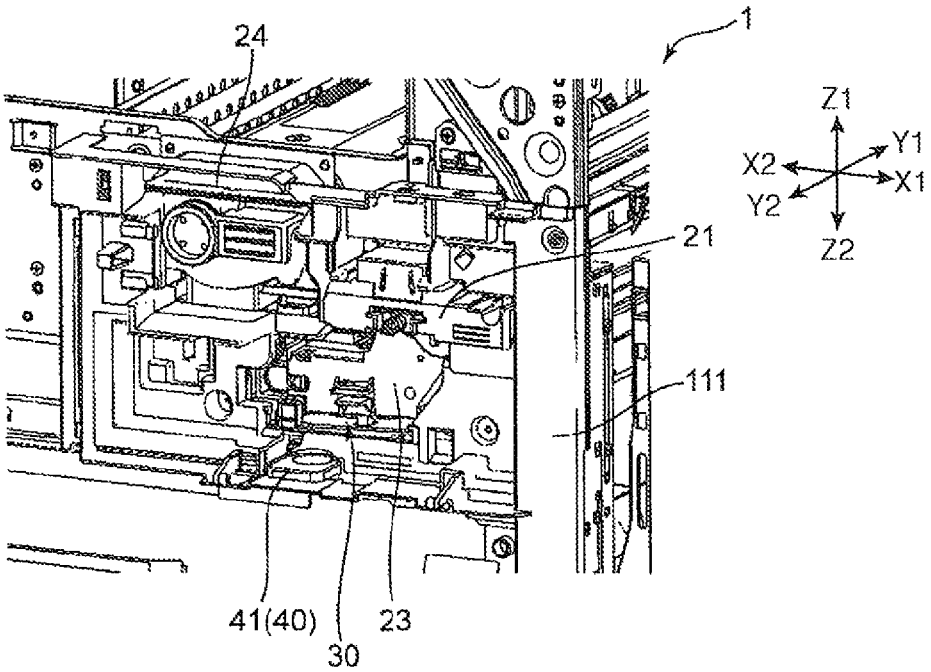
FIG. 3 is a perspective view of an appearance of the image forming apparatus according to an embodiment of the present disclosure, in the state where a front cover is removed.

Next, mainly with reference to FIGS. 2 and 3, the following describes an internal configuration of the image forming apparatus 1 according to the embodiment of the present disclosure. FIG. 2 is a cross sectional view of the internal configuration of the image forming apparatus 1. FIG. 3 is a perspective view showing the image forming apparatus 1 in the state where the front cover 110 is removed. In each of FIGS. 2 and 3, the upper right half of the lower housing 11 and the connecting housing 13 are shown. The cross section shown in FIG. 2 is taken along the right-and-left direction (X direction) of the image forming apparatus 1.

The lower housing 11 accommodates units used for image forming. The units used for image forming include a drum unit 21, an exposure unit 22, a developing unit 23, a toner container 24, a fixing unit 25, and a conveyance unit 26. These units are disposed such that each unit can be separately pulled forward relative to the lower housing 11 (a housing frame 111).

The drum unit 21 includes a photosensitive drum 211 (image bearing member), a charging device 212, and a cleaning device 214. The charging device 212 is disposed around the photosensitive drum 211. The photosensitive drum 211 rotates about its axis. The photosensitive drum 211 bears an electrostatic latent image and a toner image on its peripheral surface. The charging device 212 uniformly charges the peripheral surface of the photosensitive drum 211.

The exposure unit 22 emits laser light to the peripheral surface of the photosensitive drum 211 to form an electrostatic latent image.

The developing unit 23 includes a developing roller 231. The developing roller 231 is disposed in proximity to the photosensitive drum 211. The developing roller 231 supplies toner to the peripheral surface of the photosensitive drum 211 to develop the electrostatic latent image formed on the peripheral surface of the photosensitive drum 211.

The toner container 24 replenishes toner to the developing unit 23.

The conveyance unit 26 includes a transfer roller 213 pressed against the photosensitive drum 211. The transfer roller 213 forms a transfer nip portion N1 with the photosensitive drum 211. The transfer roller 213 transfers the toner image on the photosensitive drum 211 to the sheet.

At a downstream location near the transfer nip portion N1, a separator section 215 is disposed. The cleaning device 214 cleans the peripheral surface of the photosensitive drum 211 after the toner image transfer. The separator section 215 separates, from the photosensitive drum 211, the sheet onto which the toner image is transferred in the transfer nip portion N1. The sheet thus separated is forwarded to the fixing unit 25.

The fixing unit 25 includes a fixing roller 251 and a pressure roller 252. The fixing roller 251 includes a heat source therein. The fixing roller 251 and the pressure roller 252 together form a fixing nip portion N2.

The fixing unit 25 applies heat and pressure through the fixing nip portion N2 to the sheet onto which the toner image has been transferred in the transfer nip portion N1. The sheet subjected to the fixing process (the application of heat and pressure) by the fixing unit 25 is ejected from a sheet ejecting outlet 131 into the in-body paper ejection tray 151.

As shown in FIG. 2, a sheet conveyance path for conveying sheets is provided inside the main housing 10. The sheet conveyance path includes a main conveyance path P1 leading to the sheet ejecting outlet 131. The main conveyance path P1 extends in the up-and-down direction (Z direction) from a location near the bottom of the lower housing 11 to the connecting housing 13 via the transfer nip portion N1 and the fixing nip portion N2. In addition, a reverse conveyance path P2 is provided for conveying sheets in reverse for duplex printing. The reverse conveyance path P2 extends from the downstream end of the main conveyance path P1 to a location near the upstream end of the main conveyance path P1.

The sheet cassette 14 (see FIG. 1) is provided with a sheet accommodating section for accommodating a stack of sheets. At a location near the top right of the sheet accommodating section, a pickup roller 271 and a paper feed roller pair 272 are disposed. The pickup roller 271 picks up sheets one by one from the topmost sheet in the stack. The paper feed roller pair 272 forwards the sheet picked up by the pickup roller 271 to the upstream end of the main conveyance path P1.

A registration roller pair 273 is disposed upstream from the transfer nip portion N1 in the main conveyance path P1. The registration roller pair 273 forwards the sheet to the transfer nip portion N1 with predetermined timing.

In the image forming apparatus 1 according to the present embodiment, the inner face (left face) and the outer face (right face) of the conveyance unit 26 together form the main conveyance path P1 and the reverse conveyance path P2. For example, an immediately upstream portion of the main conveyance path P1 from the transfer nip portion N1 is defined by the inner face of the conveyance unit 26 and a pre-transfer guide 274 opposed to the conveyance unit 26. In addition to the transfer roller 213 described above, the conveyance unit 26 includes one roller in the registration roller pair 273 and one roller in a conveyance roller pair (not shown) for conveying a sheet in the reverse conveyance path P2.

The following describes an image forming operation of the image forming apparatus 1 mainly with reference to FIG. 2.

First, the charging device 212 charges the peripheral surface of the photosensitive drum 211 substantially uniformly. Next, the charged peripheral surface of the photosensitive drum 211 is exposed to laser light emitted by the exposure unit 22. As a result, an electrostatic latent image conforming to image data (image to be formed on a sheet) is formed on the peripheral surface of the photosensitive drum 211. Next, the developing unit 23 supplies toner to the peripheral surface of the photosensitive drum 211. As a result, the toner image is visualized on the peripheral surface of the photosensitive drum 211.

For example, in the single-side printing process, a sheet is fed from the sheet cassette 14 (see FIG. 1) or the manual feed tray 17 to the main conveyance path P1. Next, the transfer nip portion N1 causes the toner image to be transferred to the sheet. Subsequently, the fixing nip portion N2 causes the transferred toner image to be fixed onto the sheet. The sheet onto which the toner image is fixed is ejected through the sheet ejecting outlet 131 into the in-body paper ejection tray 151.

In the duplex printing process, on the other hand, the transfer and fixing processes described above are carried out on one side of the sheet. Then, when the sheet is partially ejected out of the sheet ejecting outlet 131 to the in-body paper ejection tray 151, switch-back conveyance is executed to pull the sheet back. In detail, the sheet is brought back up to a location close to the upstream end of the main conveyance path P1 through the reverse conveyance path P2. Then, the other surface (unprinted surface) of the sheet is subjected to the transfer process and the fixing process. After the transfer and fixing processes on the both surfaces of the sheet, the sheet is ejected through the sheet ejecting outlet 131 onto the in-body paper ejection tray 151.

Figure 13:
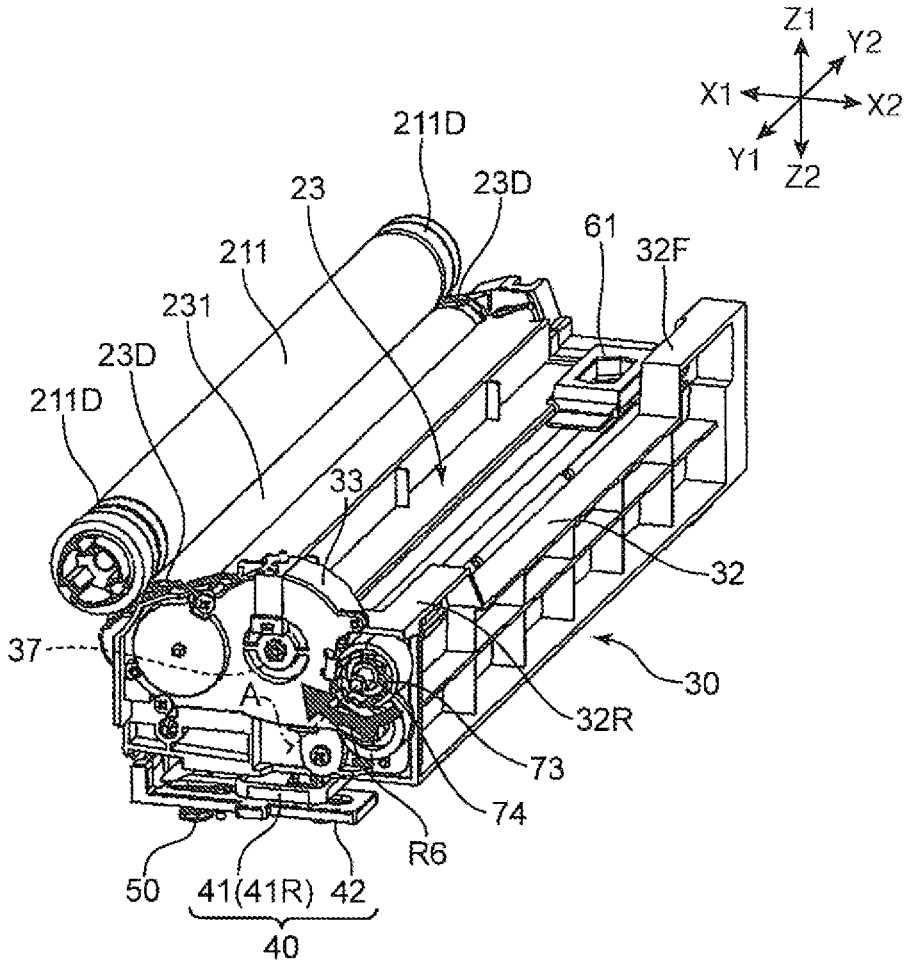
FIG. 13 is a perspective view showing a rear side of the support unit of the image forming apparatus according to the embodiment of the present disclosure.

The following describes operation of the image forming apparatus 1 when the developing unit 23 or the drum unit 21 is pulled out of the main housing 10 for maintenance or jam-handling for example, mainly with reference to FIG. 13. FIG. 13 is a perspective view showing a rear side of a support unit 30.

The image forming apparatus 1 according to the present embodiment further includes a mechanism for moving the peripheral surface of the photosensitive drum 211 and the peripheral surface of the developing roller 231 away from each other when the developing unit 23 or the drum unit 21 is pulled out of the main housing 10. In detail, the developing roller 231 includes a pair of gap rollers 23D. Each gap roller 23D is disposed in proximity to an axial edge of the developing roller 231. The photosensitive drum 211 has a non-image forming region 211D on the peripheral surface along each axial edge. Such a mechanism ensures that the image forming apparatus 1 according to the present embodiment is less prone to damage on the respective peripheral surfaces of the photosensitive drum 211 and the developing roller 231.

For example, at the time of image formation (hereinafter, referred to as "during normal operation"), the developing roller 231 and the photosensitive drum 211 are brought into a state where a predetermined gap (hereinafter, referred to as a first gap) between the respective peripheral surfaces. During the normal operation, each gap roller 23D is urged against and in contact with the corresponding non-image forming region 211D. Since the developing roller 231 is provided with the gap rollers 23D, the first gap is secured between the peripheral surface of the developing roller 231 and the peripheral surface of the photosensitive drum 211 during the normal operation.

On the other hand, when the developing unit 23 or the drum unit 21 is pulled out of the main housing 10 for maintenance or jam-handling for example, the urging force against the gap rollers 23D is released. As a consequence, the photosensitive drum 211 and the developing roller 231 are moved away from each other. As a result, a gap significantly wider than the gap during the normal operation (the first gap) is secured between the peripheral surface of the photosensitive drum 211 and the peripheral surface of the developing roller 231 (this wider gap is referred to as a second gap).

Figure 4:
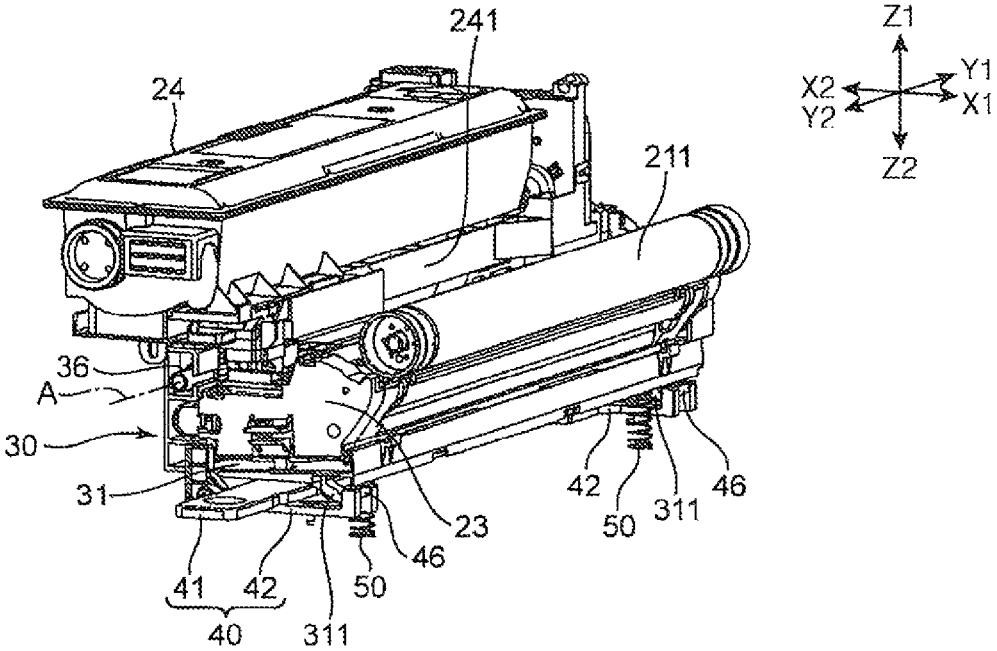
FIG. 4 is a perspective view showing a developing unit and its surrounding units of the image forming apparatus according to the embodiment of the present disclosure.
Figure 5:
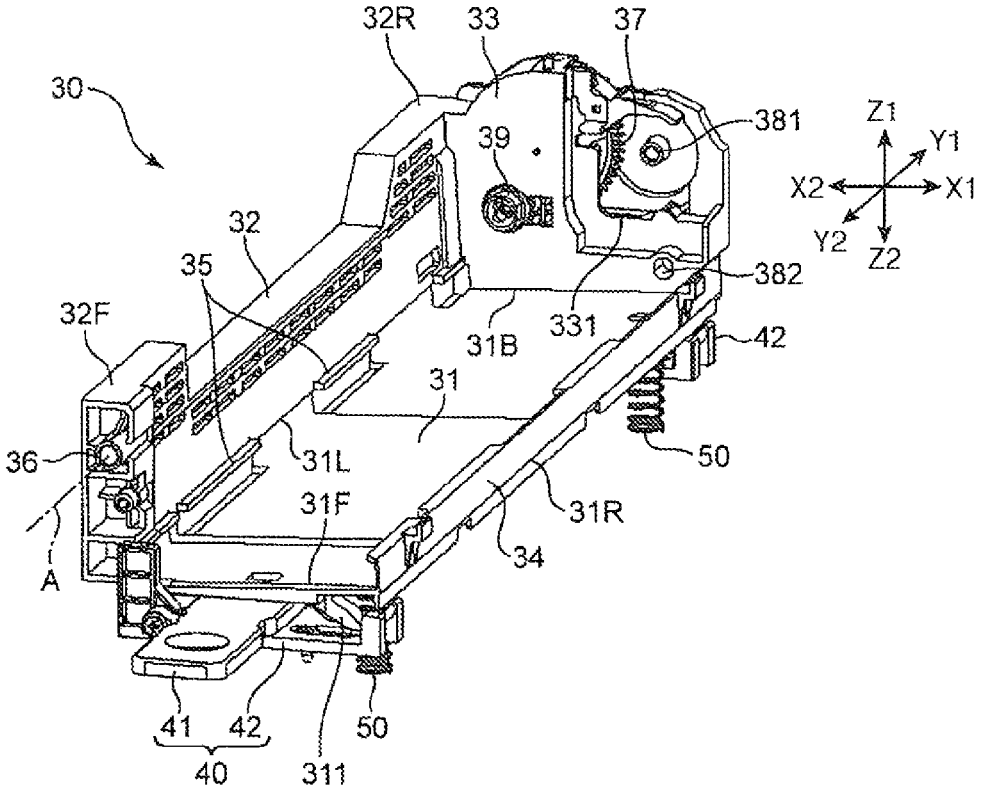
FIG. 5 is a perspective view showing a support unit and a switching mechanism of the image forming apparatus according to the embodiment of the present disclosure.
Figure 6:
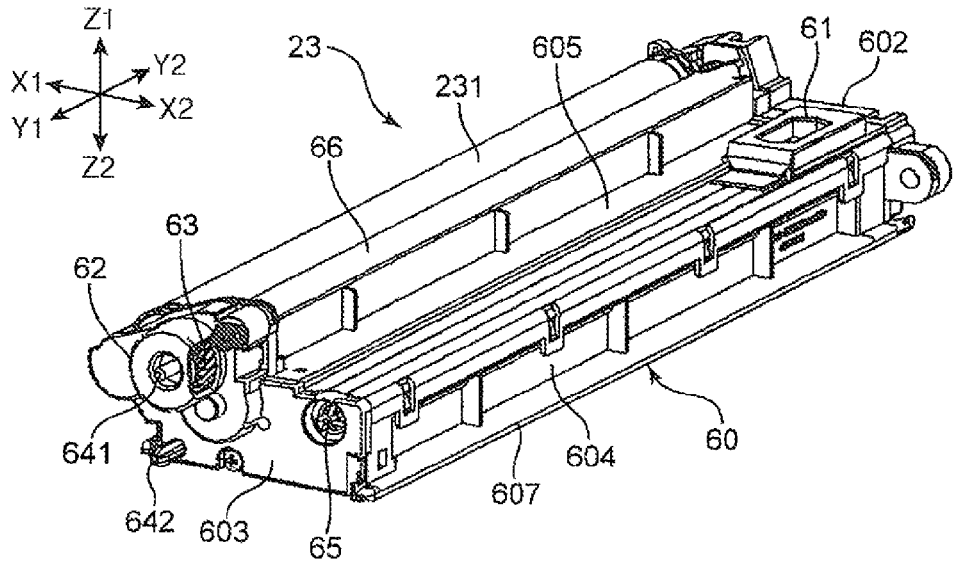
FIG. 6 is a perspective view showing the developing unit of the image forming apparatus according to the embodiment of the present disclosure.
Figure 7:
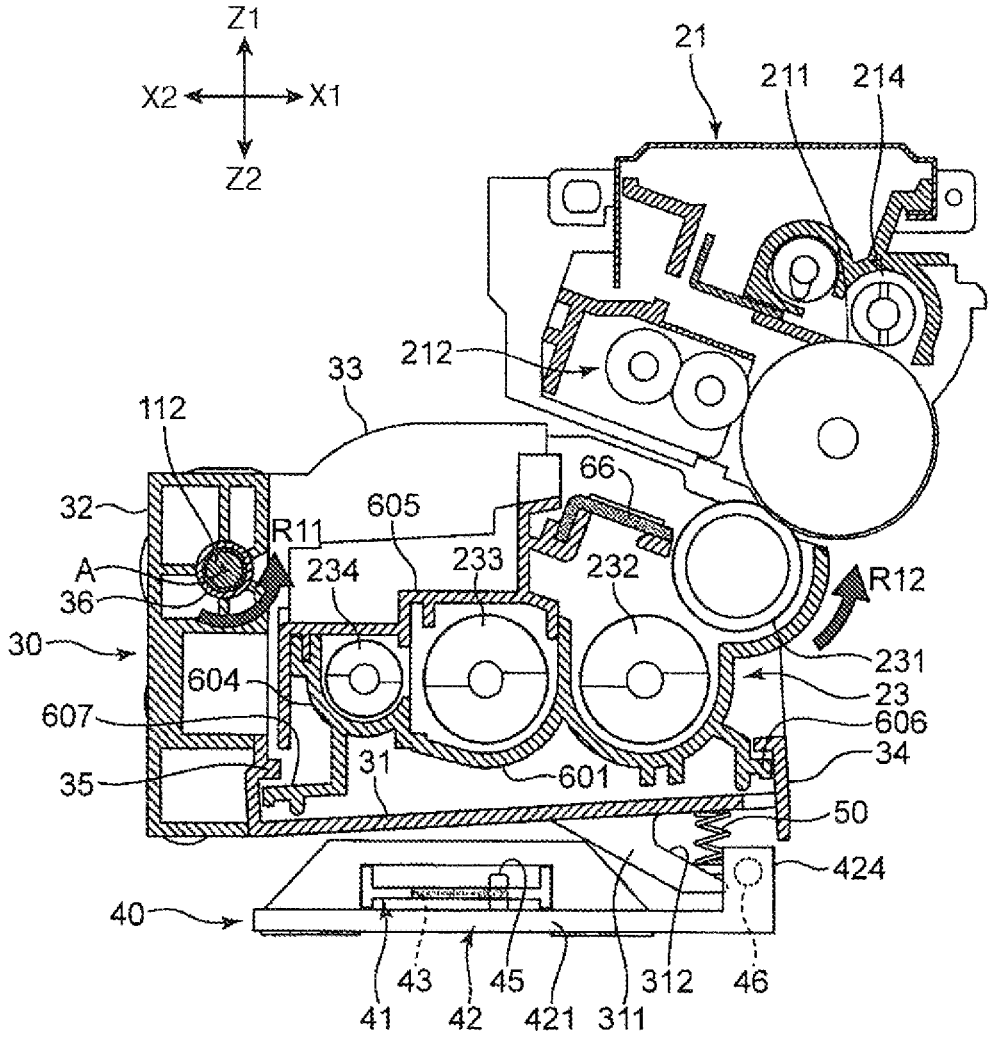
FIG. 7 is a cross sectional view showing the support unit in a fitting position (first position), of the image forming apparatus according to the embodiment of the present disclosure.
Figure 8:
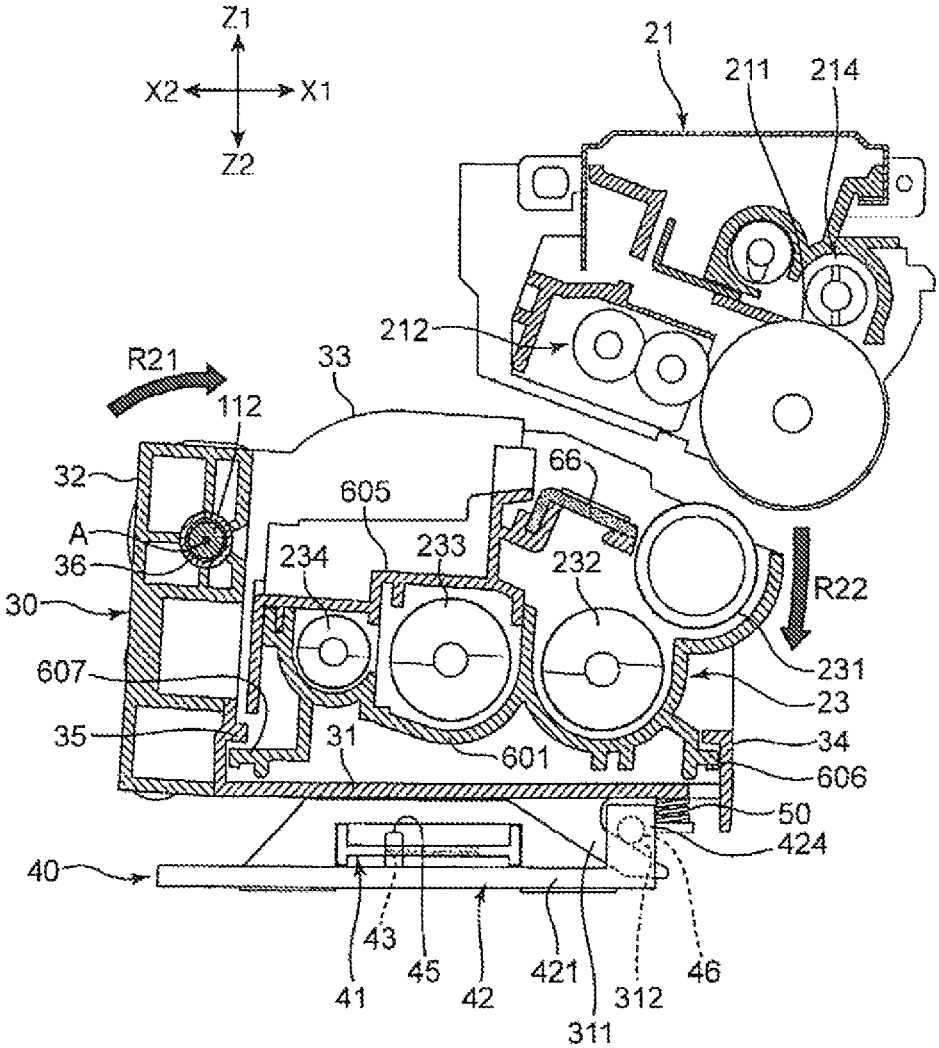
FIG. 8 is a cross sectional view showing the support unit in a releasing position (second position), of the image forming apparatus according to the embodiment of the present disclosure.

Mainly with reference to FIGS. 4-8 and 13, the following describes details of the mechanism for moving the photosensitive drum 211 and the developing roller 231 to have the respective peripheral surfaces closer to each other or away from each other. FIG. 4 is a perspective view showing the developing unit 23 along with its surrounding units. In FIG. 4, the photosensitive drum 211 is illustrated alone, from among components of the drum unit 21, in a manner to reflect its relative location. FIG. 5 is a perspective view of the support unit 30 and a switching mechanism 40. FIG. 6 is a perspective view showing the developing unit 23 alone. FIGS. 7 and 8 each show the image forming apparatus 1 with the respective units assembled in the main housing 10.

As shown in FIG. 4, the image forming apparatus 1 includes the support unit 30, the switching mechanism 40, a pair of front and rear coil springs (urging members) 50. The support unit 30 is supported by the main housing 10 to be freely pivotable about an axis of a pivot shaft A. The pivot shaft A extends in the front-and-rear direction (Y direction). The support unit 30 places and supports the developing unit 23 in position.

As shown in FIG. 5, the support unit 30 includes a base 31, a left wall 32 (first side wall), and a rear wall 33 (second side wall). The base 31 is formed of a horizontally extending plate. In detail, the base 31 is formed of a rectangular plate elongated in the front-and-rear direction (Y direction). As shown in FIG. 4, the developing unit 23 is mounted on the upper face of the base 31. The lower face of the base 31 faces toward the switching mechanism 40.

A right guide section 34 is disposed to stand vertically upward from a right edge 31R of the base 31. The right guide section 34 has an inverted L shape in cross section taken along the right-and-left direction (X direction). In addition, left guide sections 35 are disposed near a left edge 31L of the base 31. Each left guide section 35 is a convex ridge extending in the front-and-rear direction (Y direction). When slid into the support unit 30 from the front (from the Y2 direction), the developing unit 23 is guided by the right guide section 34 and the left guide section 35.

As shown in FIG. 5, the left wall 32 stands vertically upward from the left edge 31L (one edge) of the base 31. As shown in FIG. 13, the left wall 32 is a side wall parallel to the developing roller 231. The left wall 32 is higher at its front edge portion 32F and rear edge portion 32R than at its central portion.

As shown in FIG. 5, a fulcrum member 36 is provided inside the front edge portion 32F. The fulcrum member 36 is a hollow cylinder that is open toward the front (toward the Y2 direction). As shown in FIG. 13, a pin 74 is disposed inside the rear edge portion 32R to project toward the rear (toward the Y1 direction). The fulcrum member 36 and the pin 74 are coaxial. The fulcrum member 36 and the pin 74 together constitute the pivot shaft A of the support unit 30. As shown in FIGS. 7 and 8, the fulcrum member 36 is for receiving insertion of a pin member 112 of the main housing 10. In addition, the pin 74 is for insertion into a pin receiver 72 (see FIG. 11) of a drive unit 70, which will be described later. By the insertion of the fulcrum member 36 and the pin 74 with their associated members, the support unit 30 is freely pivotable about the axis of the pivot shaft A.

As shown in FIG. 13, a second coupling gear 73 (a second drive input section) is assembled to the rear edge portion 32R of the left wall 32. The second coupling gear 73 is disposed coaxially with the pin 74 (or with the pivot shaft A). The second coupling gear 73 includes, for example, gear teeth formed along an edge of a hollow cylinder that is coaxial with the pin 74. The second coupling gear 73 receives a rotational drive force from a first coupling gear 71 (see FIG. 11) of the later-described drive unit 70.

As shown in FIG. 5, the rear wall 33 stands vertically upward from a rear edge 31*b* (another edge) of the base 31. The rear wall 33 is a side wall perpendicular to the left wall 32. The left edge of the rear wall 33 is continuous with the rear edge of the left wall 32. The rear wall 33 has a hollow interior 331 in which a transmission gear 37 (transmission mechanism) is rotatably held. The transmission gear 37 receives a rotational drive force from the second coupling gear 73 (see FIG. 13). The rear wall 33 is provided with a first locating hole 381 and a second locating hole 382 that are vertically aligned on the front face (in detail, at a location closer to the right edge) of the rear wall 33. In addition, a coupling member 39 is disposed on the rear wall 33 at a location closer toward the left edge (toward the X2 direction) of the rear wall 33. The coupling member 39 receives a rotational drive force transmitted from the second coupling gear 73 (see FIG. 13).

The base 31 is open at its front edge 31F (the edge toward the Y2 direction). As shown in FIGS. 7 and 8, a pair of hooks 311 (first engaging piece) is disposed below the base 31. Each hook 311 is a plate that extends obliquely downwardly from the base 31 to form an angle of approximately 30° or so at a location near the right of the base 31. The hook 311 has a sloped portion 312. A gap is present between the sloped portion 312 and the lower face of the base 31.

The following describes the configuration of the developing unit 23 mainly with reference to FIGS. 6 and 7.

As shown in FIG. 6, the developing unit 23 includes a developing housing 60. The developing housing 60 accommodates the developing roller 231, a first stirring screw 232, a second stirring screw 233, and a toner supplying screw 234.

As shown in FIG. 6, the developing housing 60 is elongated in the front-and-rear direction (Y direction). The developing housing 60 is formed of a bottom plate 601, a front plate 602, a rear plate 603, a left plate 604, and a top plate 605. As shown in FIG. 7, the developing housing 60 has an opening at a location near the right edge (the edge toward the X1 direction) of the developing housing 60. The opening opens toward the Z1 direction and extends in the front-and-rear direction (Y direction). In the opening, the developing roller 231 is exposed halfway around the peripheral surface.

As shown in FIG. 6, the developing roller 231 is for bearing toner on its peripheral surface. The developing roller 231 is supported by the developing housing 60 to be freely rotatable. As shown in FIG. 7, the peripheral surface of the developing roller 231 is opposed to the peripheral surface of the photosensitive drum 211. The toner carried on the developing roller 231 is supplied to the photosensitive drum 211. With the toner supplied to the developing roller 231, the electrostatic latent image formed on the peripheral surface of the photosensitive drum 211 is developed into a toner image.

Each gap roller 23D described above (see FIG. 13) is disposed at a location near the axial edge of the developing roller 231. As shown in FIG. 7, the first and second stirring screws 232 and 233 convey toner while stirring the toner within the developing housing 60. In addition, the first and second stirring screws 232 and 233 charge the toner. The toner supplying screw 234 is for uniformly supplying toner to the second stirring screw 233 (in greater detail, within the housing space accommodating the second stirring screw 233).

As shown in FIG. 6, the top plate 605 has a toner inlet 61 at a location near its front edge. The toner inlet 61 is for introducing toner into the developing housing 60. At the time of toner replenishment, toner stored in the toner container 24 (see FIG. 4) is supplied to an intermediate hopper 241 (see FIG. 4) and then into the developing housing 60 from the toner inlet 61.

The following now describes a configuration of the intermediate hopper 241 mainly with reference to FIG. 4.

The intermediate hopper 241 includes a receiving port, a discharge port, and a toner conveyance path. The receiving port receives toner supplied from the toner container 24. The discharge port is opposed to the toner inlet 61. The discharge port includes a shutter member. The shutter member opens and closes in response to detachment/attachment of the developing housing 60 (see FIG. 6) from/to the main housing 10. The toner conveyance path connects the receiving port and the discharge port.

In the image forming apparatus 1 according to the present embodiment, the intermediate hopper 241 is located between the toner container 24 and the developing unit 23. With such a configuration, the image forming apparatus 1 allows the developing unit 23 to be detached alone from the main housing 10, i.e., separately from the toner container 24.

With reference to FIGS. 6 and 7, the following continues the description of the configuration of the developing unit 23. With the developing unit 23 mounted on the base 31 of the support unit 30, the bottom plate 601 faces toward the base 31 as shown in FIG. 7 and the rear plate 603 (see FIG. 6) faces toward the rear wall 33 as shown in FIG. 13. As shown in FIG. 6, a gear housing 62 is disposed to project at a location on the rear plate 603 near the right edge thereof. The gear housing 62 accommodates a developing-roller driving gear 63 (first drive input section).

As shown in FIG. 6, the gear housing 62 has an opening at a location toward the left (toward the X2 direction). The gear teeth of the developing-roller driving gear 63 are partly exposed through the opening. As shown in FIG. 13, the developing-roller driving gear 63 is attached to the rear end of the rotary shaft of the developing roller 231. By the rotational drive force supplied to the developing-roller driving gear 63, the developing roller 231 rotates about the axis of the rotary shaft.

The rear plate 603 has a window portion at a location near its left edge. A coupling socket 65 is exposed through the window portion. The coupling socket 65 is directly connected to the rear end of the rotary shaft of the toner supplying screw 234 (see FIG. 7). By the rotational drive force supplied to the coupling socket 65, the toner supplying screw 234 (see FIG. 7) rotates about the axis of the rotary shaft.

A first locating pin 641 and a second locating pin 642 are each disposed on the rear plate 603 to project at a location near the right edge of the rear plate 603 (the edge toward the X1 direction). The first and second locating pins 641 and 642 are at locations aligned in the up-and-down direction. The first locating pin 641 is located centrally of the gear housing 62. The second locating pin 642 is located near the lower edge of the rear plate 603.

As shown in FIG. 7, the bottom plate 601 is provided with a right guide rib 606 (see FIG. 7) along its right edge. The right guide rib 606 projects toward the right (toward the X1 direction) and extends in the front-to-rear direction (Y direction). As shown in FIG. 6, the bottom plate 601 is provided with a left guide rib 607 along its left edge. The left guide rib 607 projects toward the left (toward the X2 direction) and extends in the front-to-rear direction (Y direction). A blade 66 is attached to the right edge of the top plate 605. The blade 66 limits the thickness of the toner layer carried on the peripheral surface of the developing roller 231.

The following describes the method for attaching the developing unit 23 to the main housing 10 (see FIG. 1), mainly with reference to FIGS. 5-7.

The developing unit 23 is attached to the main housing 10 by a user. In detail, the developing unit 23 is mounted into the support unit 30 from the front (from the Y2 direction) by sliding the developing unit 23 on the base 31 toward the rear (toward the Y1 direction) of the support unit 30. In this way, the developing unit 23 is attached to the main housing 10. To attach the developing unit 23 into the main housing 10, it is preferable to fit the right and left guide ribs 606 and 607 respectively into the right and left guide sections 34 and 35 of the support unit 30. By doing so, the right and left guide ribs 606 and 607 are respectively guided by the right and left guide sections 34 and 35 when the developing unit 23 slides toward the rear. This enables the developing unit 23 to stably slide on the base 31. Note that the developing unit 23 is detached from the main housing 10 through a procedure in reverse of the above-described procedure.

In the attachment of the developing unit 23 to the main housing 10, when the rear plate 603 of the developing unit 23 reaches a predetermined location near the rear wall 33 of the support unit 30, the first and second locating pins 641 and 642 come to be inserted into the first and second locating holes 381 and 382, respectively. In addition, the coupling socket 65 is coupled to the coupling member 39.

By the insertion of the first and second locating pins 641 and 642 respectively into the first and second locating holes 381 and 382, the developing unit 23 is placed into an appropriate relative location with respect to the support unit 30. In this positional relation, the developing-roller driving gear 63 makes mesh engagement with the transmission gear 37. The gear teeth of the transmission gear 37 are partly exposed from the housing constituting the rear wall 33. Part of the exposed gear teeth meshes with the exposed part of the gear teeth of the developing-roller driving gear 63 described above. In addition, the coupling socket 65 is coupled with the coupling member 39.

Then, the rotational drive force of the second coupling gear 73 is transmitted to the transmission gear 37 and the developing-roller driving gear 63. This enables the developing roller 231 to rotate. Similarly, the rotational drive force is transmitted to the coupling member 39 and the coupling socket 65 to enable the toner supplying screw 234 to rotate.

The pair of coil springs 50 is a member that supplies an urging force to the support unit 30. The support unit 30 is loaded with the developing unit 23. With the urging force supplied by the coil springs 50, the support unit 30 can pivot about the axis of the pivot shaft A. The urging force supplied by the coil spring 50 is to pivot the support unit 30 in a direction for moving the peripheral surface of the developing roller 231 toward the peripheral surface of the photosensitive drum 211 (approaching direction).

The pair of coil springs 50 is oriented such that each extending direction coincides with the up-and-down direction (Z direction). The upper end portion of each coil spring 50 is in contact with the lower face of the base 31 at a location near the right edge of the base 31. The bottom end portion of each coil spring 50 is in contact with a securing frame member (not shown) of the main housing 10. The coil springs 50 upwardly urge the lower face of the base 31 each at a location near the right edge 31R.

The switching mechanism 40 switches the position of the support unit 30 supporting the developing unit 23. The switching is made between the fitting position (first position) in which the peripheral surface of the developing roller 231 is located relatively close to the peripheral surface of the photosensitive drum 211 and a releasing position (second position) in which the peripheral surface of the developing roller 231 is located relatively away from the peripheral surface of the photosensitive drum 211 by resisting the urging force of the coil spring 50.

The following describes the method in which the switching mechanism 40 performs the position switching of the support unit 30, mainly with reference to FIGS. 7, 8, and 13. FIG. 7 is a cross sectional view showing the support unit 30 in the fitting position. FIG. 8 is a cross sectional view showing the support unit 30 in the releasing position.

To switch the support unit 30 into the fitting position, the switching mechanism 40 supplies no constraining force on the support unit 30. Consequently, the urging force of the coil springs 50 is supplied on the support unit 30. Thus, the support unit 30 pivots about the pivot shaft A (the axis of the fulcrum member 36) in the counterclockwise direction indicated by the arrow R11 in FIG. 7. Then, as the support unit 30 pivots, the developing roller 231 is pressed in a direction toward the photosensitive drum 211 as indicated by the arrow R12 in FIG. 7. As a result, each gap roller 23D is pressed against the non-image forming region 211D of the photosensitive drum 211 to leave a predetermined gap between the peripheral surface of the developing roller 231 and the peripheral surface of the photosensitive drum 211 as shown in FIG. 13. This state where the peripheral surface of the developing roller 231 is located relatively close to the peripheral surface of the photosensitive drum 211 is the fitting position. The fitting position is taken when the image forming apparatus 1 performs image forming processing.

On the other hand, to switch the support unit 30 into the releasing position, the switching mechanism 40 supplies a constraining force on the support unit 30. In detail, the switching mechanism 40 supplies a force pressing the hooks 311 downward against the urging force of the coil springs 50. In response, the base 31 is pressed downward along its right edge (the edge toward the X1 direction). Consequently, the support unit 30 pivots about the pivot shaft A in the clockwise direction indicated by the arrow R21 in FIG. 8. Then, as the support unit 30 pivots, the developing roller 231 is pressed to move in a direction away from the photosensitive drum 211 as indicated by the arrow R12 in FIG. 8. As a result, a relatively large gap is secured between the peripheral surface of the developing roller 231 and the peripheral surface of the photosensitive drum 211. This state where the peripheral surface of the developing roller 231 is located relatively away from the peripheral surface of the photosensitive drum 211 is the releasing position. The releasing position is taken to allow the developing unit 23 to be pulled forward away from the support unit 30 (or to be pressed rearward into the support unit 30).

Figure 9:
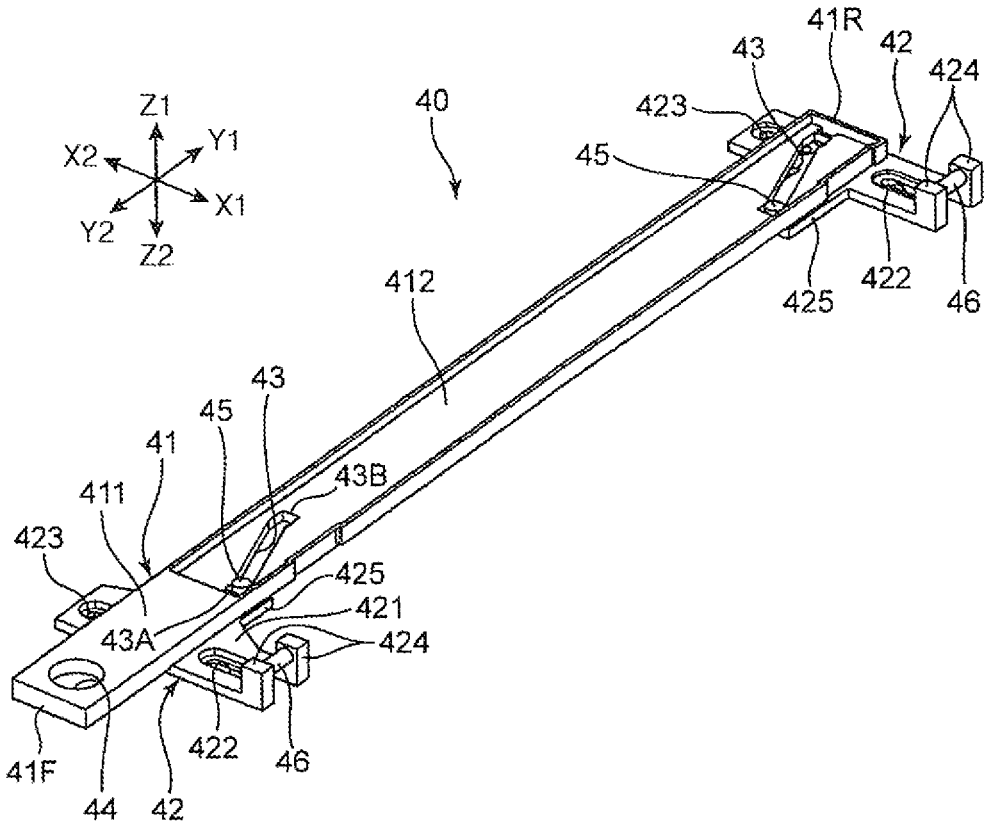
FIG. 9 is a perspective view showing the switching mechanism in the state where switching to the fitting position is effected, of the image forming apparatus according to the embodiment of the present disclosure.
Figure 10:
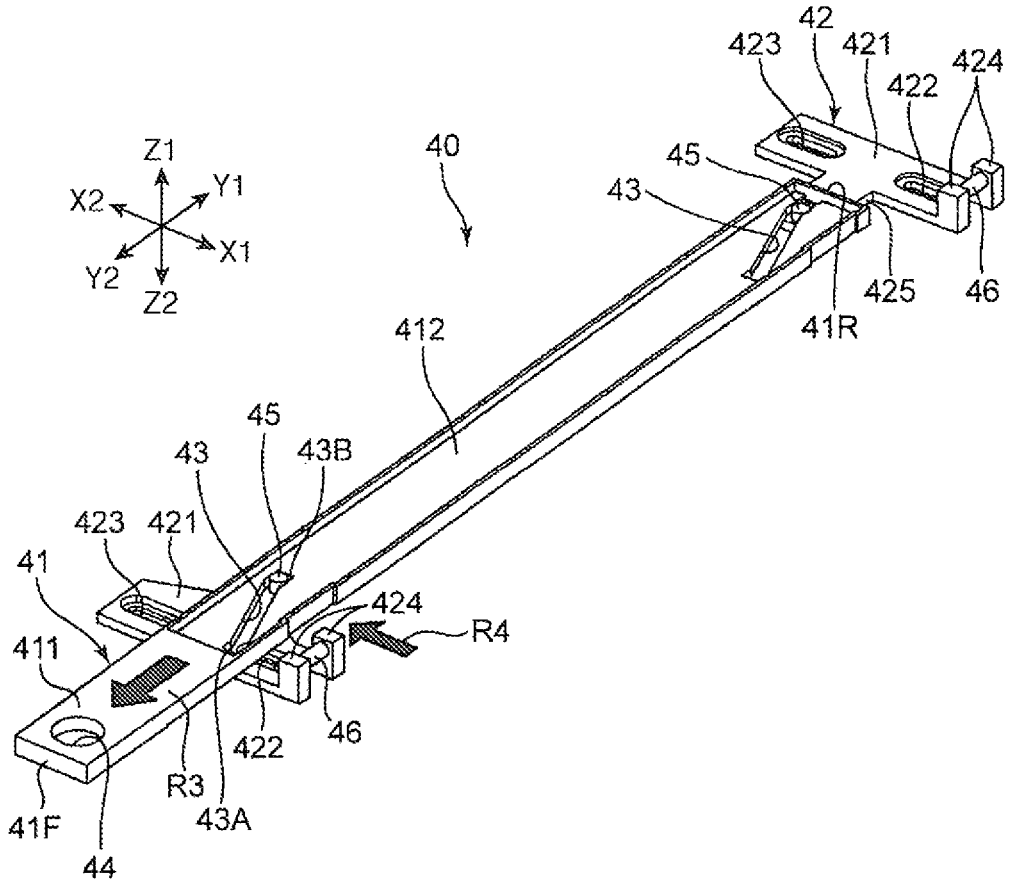
FIG. 10 is a perspective view showing the switching mechanism in the state where switching to the releasing position is effected, of the image forming apparatus according to the embodiment of the present disclosure.

The following describes the configuration of the switching mechanism 40 mainly with reference to FIGS. 9 and 10. The switching mechanism 40 performs the position switching of the support unit 30 between the fitting position and the releasing position. FIG. 9 is a perspective view showing the switching mechanism 40 in the state where switching to the fitting position is effected. FIG. 10 is a perspective view showing the switching mechanism 40 in the state where switching to the releasing position is effected.

The switching mechanism 40 includes a lever member 41 movable in the front-and-rear direction (Y direction) and two movable plates 42 each movable in the right-and-left direction (X direction) cooperatively with the front-to-rear (Y direction) movement of the lever member 41. The movable plates 42 are disposed below the lever member 41. In detail, the two movable plates 42 are spaced apart in the front-and-rear direction (Y direction).

The lever member 41 is a plate elongated in the front-and-rear direction (Y direction). The lever member 41 includes an operation portion 411 at the front (toward the Y2 direction) and a transitional portion 412 continuous from the rear portion (the portion toward the Y1 direction) of the operation portion 411.

The operation portion 411 occupies ⅕ or so of the entire length of the lever member 41, starting from the front edge 41F in the front-and-rear direction (Y direction). The operation portion 411 is relatively thick in the up-and-down direction (Z direction). The operation portion 411 has an operation hole 44 therethrough for insertion of a user's finger when the user operates the lever member 41. In FIGS. 3 and 4, the forwardly (toward the Y2 direction) protruding portion corresponds to the operation portion 411.

The transitional portion 412 is relatively thin in the up-and-down direction (Z direction). The outer edges of the transitional portion 412 are surrounded by a rib having the same thickness as the operation portion 411. Of the two movable plates 42, one at the front (toward the Y2 direction) is disposed at a location near the front edge of the transitional portion 412. On the other hand, the movable plate 42 at the rear (toward the Y1 direction) is disposed at a location near the rear edge of the transitional portion 412. The transitional portion 412 has slits 43 one near the front edge and another near the rear edge thereof. Each slit 43 extends in a direction oblique to the extending direction of the lever member 41.

The following describes the slit 43 located at the front (toward the Y2 direction). The slit 43 has a proximal end 43A at a location near the front edge and near the right edge of the transitional portion 412. The slit 43 extends from the proximal end 43A in a direction obliquely rearward left (toward the X2-Y1 direction) to reach a distal end 43B located at a predetermined distance rearward (toward the Y1 direction) from the front edge of the transitional portion 412. The distal end 43B is at a location near the left edge of the transitional portion 412. The slit 43 at the rear (toward the Y1 direction) is identical in shape to the slit 43 at the front. The distal end of the slit 43 at the rear (the portion corresponding to the distal end 43B) reaches a location near the rear edge 41R of the lever member 41 (the rear edge of the transitional portion 412).

Each movable plate 42 includes a base plate 421, a first guide groove 422, a second guide groove 423, a fitting pin 45, and an engaging pin 46 (second engaging piece). The base plate 421 is a flat plate elongated in the right-and-left direction (X direction). The first and second guide grooves 422 and 423 each extend through the entire base plate 421 in the up-and-down direction. The fitting pin 45 stands vertically on the upper face of the base plate 421. The engaging pin 46 is attached to the base plate 421 at a location near the right edge of the base plate 421.

The first and second guide grooves 422 and 423 are each formed at a location centrally of the base plate 421 in the front-and-rear direction (Y direction). The first and second guide grooves 422 and 423 each extend in the right-and-left direction (X direction). The first guide groove 422 is located closer to the right (toward the X1 direction), whereas the second guide groove 423 is located closer to the left (toward the X2 direction). The first guide groove 422 has, for example, a U shape that is open at the right edge (the edge toward the X1 direction) in top view. The second guide groove 423 has, for example, an elliptical shape in top view.

The main housing 10 has guide pins (not shown) secured thereto. The guide pins are respectively fitted into the guide grooves 422 and 423. The engagement of the guide pins into the guide grooves 422 and 423 prevents each movable plate 42 from being detached upward (toward Z1 direction) from the main housing 10. By being guided by the respective guide pins engaged with the first and second guide grooves 422 and 423, the movable plate 42 is allowed to move in the right-and-left direction (X direction). The width of the second guide groove 423 in the right-and-left direction (X direction) determines a movement stroke of the movable plate 42 in the right-and-left direction (X direction).

The movable plate 42 at the front (toward the Y2 direction) has an extended portion 425 extended from a location toward the rear of the base plate 421 (toward the Y1 direction). The fitting pin 45 vertically stands on the top face of the extended portion 425. The fitting pin 45 is fitted into the slit 43.

As described above, the slit 43 extends obliquely, rather than straight in the front-and-rear direction (Y direction). The lever member 41 guided by a guide member (not shown) to move straight along the front-and-rear direction (Y direction). As the lever member 41 moves in the front-and-rear direction (Y direction), the fitting pin 45 is guided by the slit 43. Consequently, the movable plate 42 moves in the right-and-left direction (X direction). With the fitting pin 45 engaged with the slit 43, the movement stroke of the lever member 41 in the front-and-rear direction (Y direction) is limited to the length of the slit 43 in the front-and-rear direction (Y direction).

The engaging pin 46 has a cylindrical shape extending in the front-and-rear direction (Y direction). A pair of front and rear retaining portions is provided to upwardly (in the Z1 direction) stand on the right edge of the upper face of the base plate 421. The pair of front and rear retaining portions 424 retains the engaging pin 46 by holding the respective ends of the engaging pin 46. The engaging pins 46 are engageable with the respective hooks 311 (first engaging piece) of the support unit 30 (see FIGS. 7 and 8).

The following describes the operation of the switching mechanism 40 mainly with reference to FIGS. 7 to 10.

When the lever member 41 is pressed to the rearmost location (toward the Y1 direction), the switching mechanism 40 is placed into the state shown in FIGS. 7 and 9 (the state where the lever member 41 is in the second location). In this state, each fitting pin 45 is in contact with the proximal end 43A of the corresponding slit 43. In addition, each movable plate 42 is located the rightmost (toward the X1 direction).

As shown in FIG. 7, each hook 311 has the sloped portion 312 that slopes downwardly toward the right (toward the X1 direction). An opening gap is secured between the tip (lower end) of the hook 311 and the lower face of the base 31. When the lever member 41 is at the rearmost location (toward the Y1 direction), each engaging pin 46 is located to the right (toward the X1 direction) of the opening gap. Note that the engaging pin 46 is located higher than the lower end of the hook 311. In the state shown in FIG. 7, the engaging pin 46 is retracted to a location toward the right (toward the X1 direction), the engagement between the engaging pin 46 and the hook 311 of the support unit 30 is released. When the engagement between the engaging pin 46 and the hook 311 is released, the urging force of the coil springs 50 acts on the support unit 30 without being restricted. Therefore, the support unit 30 is urged upward by the coil springs 50. As a consequence, the support unit 30 takes the fitting position.

When the lever member 41 in the state shown in FIG. 9 is pulled forward (in the direction indicated by the arrow R3 in FIG. 10) to bring the front edge 41F to the foremost location, the switching mechanism 40 is placed into the state shown in FIGS. 8 and 10 (the state where the lever member 41 takes the first position). In this state, the fitting pin 45 is in contact with the distal end 43B of the slit 43. As the fitting pin 45 moves from the proximal end 43A toward the distal end 43B, the movable plate 42 is guided by the slits 43 to move toward left (toward the X2 direction) as indicated by the arrow R4 in FIG. 10. When the fitting pin 45 reaches the distal end 43B, the movable plate 42 comes to be located at the leftmost location (toward the X2 direction).

As shown in FIG. 8, when the lever member 41 is placed to the foremost location (toward the Y2 direction), the engaging pin 46 has moved toward the left (X2 direction) to engage with the hook 311. In detail, when the movable plate 42 moves toward the left (toward the X2 direction), the engaging pin 46 also moves toward the left (toward the X2 direction). As a consequence, the engaging pin 46 comes to engage the hook 311 at the lower end of the sloped portion 312. Thereafter, as the engaging pin 46 slides along the sloped portion 312 toward the left (toward the X2 direction), the support unit 30 is gradually pressed downward. In this way, the support unit 30 receives via the hooks 311 a force pressing the support unit 30 downward against the urging force of the coil springs 50. As a consequence, the support unit 30 is placed in the releasing position.

The image forming apparatus 1 further includes the drive unit 70. The drive unit 70 is assembled to the main housing 10. The drive unit 70 generates a drive force for driving the photosensitive drum 211, the developing roller 231, and the like. The following describes a configuration of the developing unit 70 mainly with reference to FIG. 11.

The drive unit 70 includes a gear housing 70H and a drive motor (not shown). The gear housing 70H accommodates a plurality of gear trains. The drive motor supplies a rotational drive force to each gear train. The gear housing 70H is assembled to the front face (toward the Y2 direction) of a side frame 18, which is a component of the main housing 10. The drive motor is attached to the rear face (toward the Y1 direction) of the side frame 18. Note that the gear housing 70H functions as a retaining member of a high-voltage board 19. On the high-voltage board 19, electric components (for example, a power semiconductor) operating at high-voltage are mounted.

The drive unit 70 has a drive output shaft. The drive output shaft generates a rotational drive force that rotates about its axis. According to the present embodiment, the first coupling gear 71 is an example of the drive output shaft.

The first coupling gear 71 includes a hollow cylinder and gear teeth formed along an edge of the hollow cylinder. The first coupling gear 71 is coupled with the second coupling gear 73 (see FIG. 13). The first coupling gear 71 is provided with the pin receiver that is disposed on its axis. The pin receiver 72 is for insertion of the pin 74 (see FIG. 13). The pin 74 is coaxial with the second coupling gear 73. The first coupling gear 71 generates a rotational drive force for counterclockwise rotation as indicated by the arrow R5 in FIG. 11.

Figure 11:
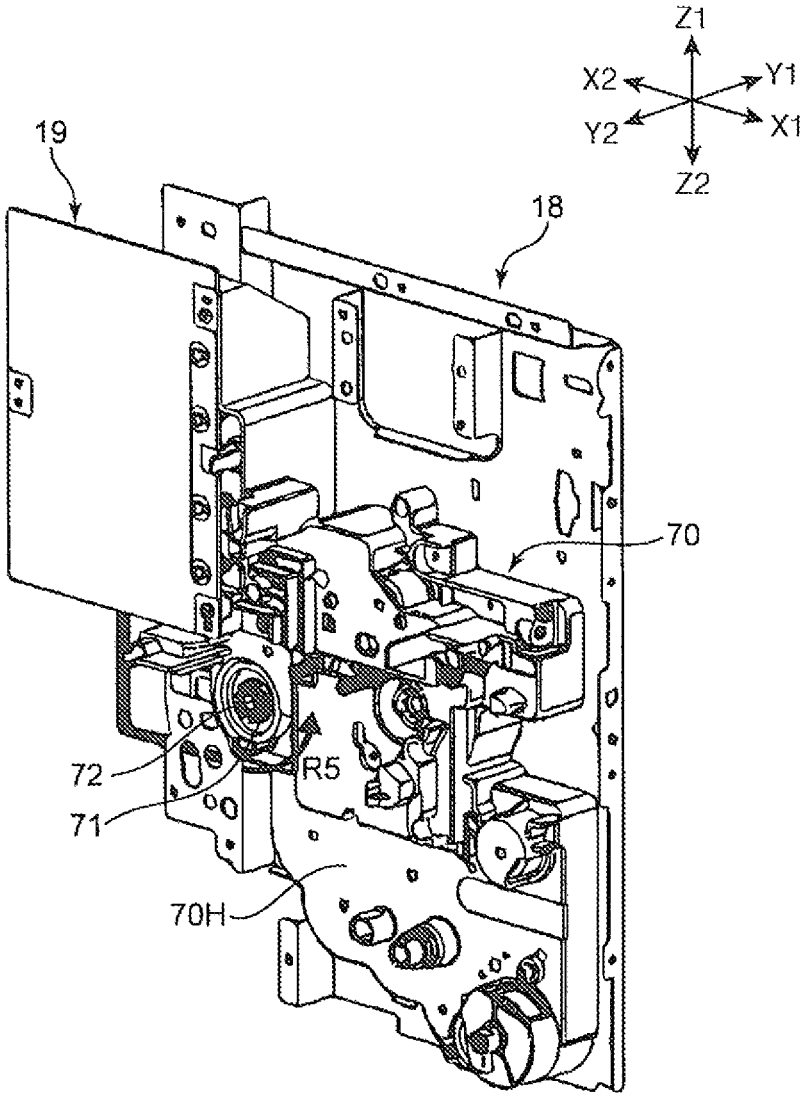
FIG. 11 is a perspective view showing a drive unit of a main housing of the image forming apparatus according to the embodiment of the present disclosure.
Figure 12:
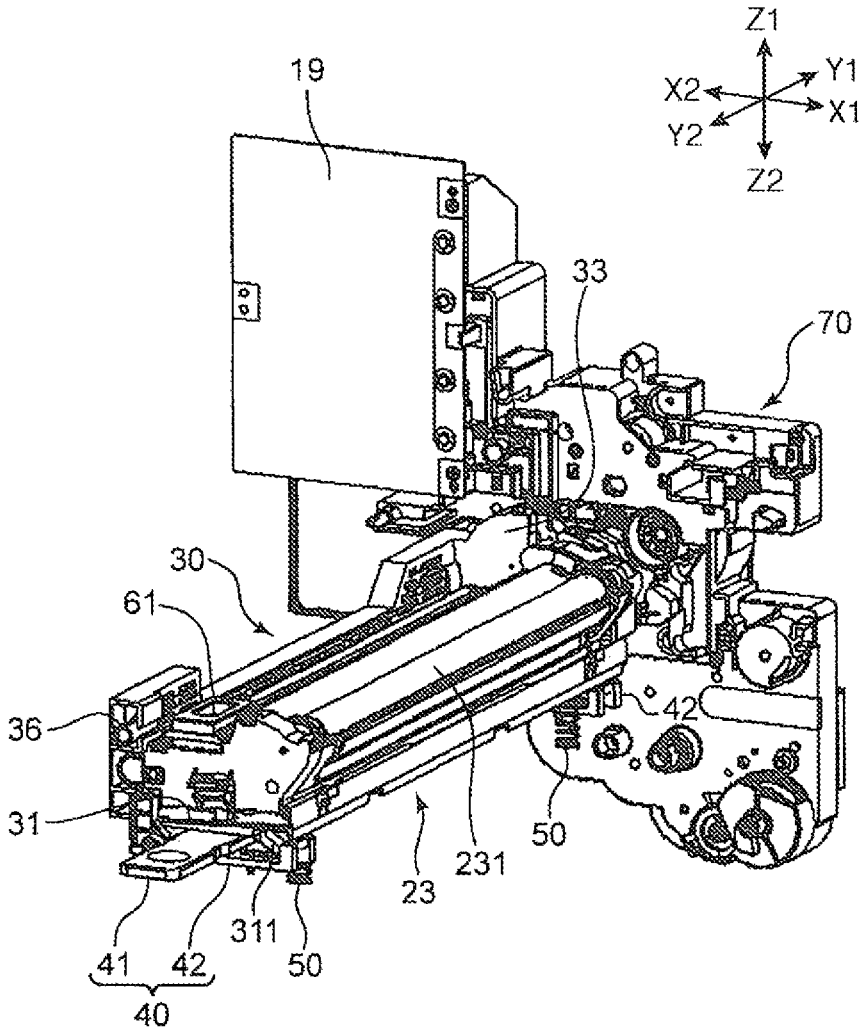
FIG. 12 is a perspective view showing the drive unit in an assembled state with the developing unit and the support unit, of the image forming apparatus according to the embodiment of the present disclosure.

The following describes the assembled state of the drive unit 70 with the developing unit 23 and the support unit 30, mainly with reference to FIGS. 11-13. FIG. 12 is a perspective view showing the assembled state of the drive unit 70 with the developing unit 23 and the support unit 30.

For example, the support unit 30 on which the developing unit 23 is mounted is assembled to the drive unit 70. In the state where the support unit 30 is assembled to the drive unit 70 (the state shown in FIG. 12), the rear wall 33 is in contact with the gear housing 70H (see FIG. 11). The second coupling gear 73 is exposed from the rear wall 33. This allows the first coupling gear 71 to be coupled with the second coupling gear 73. In addition, the pin 74 is inserted into the pin receiver 72. In the state shown in FIG. 12, the rotational drive force of the first coupling gear 71 can be transmitted to the second coupling gear 73. In the state shown in FIG. 12, in addition, the support unit 30 is supported axially by the pin receiver 72 (and by the pin member 112 inserted into the fulcrum member 36).

When the drive motor described above is driven in the state shown in FIG. 12, the first coupling gear 71 rotates in the direction indicated by the arrow R5 shown in FIG. 11. In addition, the second coupling gear 73 rotates in the direction indicated by the arrow R6 shown in FIG. 13. In addition, as the second coupling gear 73 rotates, the transmission gear 37 and the developing roller 231 rotate.

In the image forming apparatus 1 according to the present embodiment, the rotation direction R5 of the first coupling gear 71 and the rotation direction R6 of the second coupling gear 73 are both in the direction for moving the developing roller 231 toward the photosensitive drum 211. The rotation directions R5 and R6 each coincide with the pivoting direction for moving the peripheral surface of the developing roller 231 toward the peripheral surface of the photosensitive drum (approaching direction), out of the two possible pivot directions about the axis of the pivot shaft A. The fulcrum member 36 and the pin 74 of the support unit 30 together constituting the pivot shaft A are both coaxial with the first and second coupling gears 71 and 73. When each of the first and second coupling gears 71 and 73 rotates, a driving force acts on the support unit 30 for pivoting the support unit 30 about the axis of the pivot shaft A in the corresponding rotation direction.

In the image forming apparatus 1 according to the present embodiment, the developing unit 23 is supported by the support unit 30 to be freely pivotable about the pivot shaft A. The support unit 30 is urged by the coil springs 50 in the approaching direction for moving the peripheral surface of the developing roller 231 toward the peripheral surface of the photosensitive drum 211. The coil springs 50 generate an urging force urging the support unit 30 to pivot. In detail, in the state mounted on the top face of the horizontal base 31, the developing unit 23 is urged to pivot about the axis of the pivot shaft A by the urging force of the coil springs 50. The pivot shaft A is disposed on the left wall 32.

In addition, the first coupling gear 71 (the drive output shaft of the drive unit 70) is set to generate a rotational drive force in the direction for pivoting the support unit 30 into the approaching direction. That is, the support unit 30 is pivoted by the urging force of the coil springs 50 and also by the rotational drive force of the first coupling gear 71 (the drive output shaft of the drive unit 70). In the image forming apparatus 1 according to the present embodiment, the force required to pivot the support unit 30 about the axis of the pivot shaft A is supplied partly by the urging force of the coil springs 50 and partly by the driving force generated by the rotation of the first coupling gear 71.

Since the rotational drive force generated by the first coupling gear 71 (the output shaft of the drive unit 70) contributes the pivoting of the support unit 30, the urging force of the coil springs 50 is allowed to be smaller. In detail, when the image forming apparatus 1 is in the operating state (the state where the developing roller 231 is rotated), the driving force generated by rotation of the first coupling gear 71 serves as an additional urging force. Therefore, the force pressing the gap rollers 23D against the non-image forming regions 211D of the photosensitive drum 211 is unlikely to fall short even if the urging force of the coil springs 50 is small.

Reducing the urging force of the coil springs 50 improves the operability of the switching mechanism 40. In detail, the switching mechanism 40 switches the support unit 30 from the fitting position to the releasing position by resisting the urging force of the coil springs 50. Therefore, the force required for the user to apply when making an operation for effecting the switching can be made smaller.

As described above, the switching mechanism 40 according to the present embodiment is simple in configuration. The switching mechanism 40 according to the present embodiment can perform the position switching of the support unit 30 between the fitting position and the releasing position, simply by switching the location of the lever member 41 between the front and the rear. The switching mechanism 40 according to the present embodiment can reduce the urging force of the coil springs 50 acting on the support unit 30 when the lever member 41 is pulled toward the front (moving the lever member 41 from the second location to the first location). As a result, the operability of the lever member 41 improves.

As has been described above, the image forming apparatus 1 according to the present embodiment is provided with a mechanism for moving the developing roller 231 closer to and away from the photosensitive drum 211. This can improve the user operability for causing the distal and proximal movements.

The embodiment described above is one example and may be modified. For example, the embodiment described above employs the first coupling gear 71 as the drive output shaft and the second coupling gear 73 as the second drive input section. In addition, the first coupling gear 71 is provided with the pin receiver 72 that is disposed on its axis, and the second coupling gear 73 is provided with the pin 74 that is disposed on its axis. Such configuration is simple and still allows the drive force to be transmitted from the drive output shaft to the second drive input section and also allows the pivot shaft and the second drive input section to be coaxial. However, the above configuration is without limitation and may be replaced by another configuration. For example, spur gears may be used instead.

What is claimed is:

1. An image forming apparatus comprising:

a main housing;

a drive unit including a drive output shaft configured to generate a rotational drive force for axial rotation;

an image bearing member disposed in the main housing and having a peripheral surface for bearing a toner image;

a developing unit attached to the main housing to be detachable by pulling out, the developing unit including a developing roller having a peripheral surface for carrying toner thereon and configured to supply the toner to the image bearing member, and a first drive input section configured to supply a rotational drive force to the developing roller;

a support unit supported by the main housing to be freely pivotable about an axis of a pivot shaft, the supporting unit being configured to place and support the developing unit in position;

an urging member configured to generate an urging force for urging the support unit to pivot in one of pivoting directions about the pivot shaft, the one pivoting direction coinciding with an approaching direction for moving the peripheral surface of the developing roller toward the peripheral surface of the image bearing member; and a switching mechanism configured to switch the support unit supporting the developing unit, the switching being made between a first position in which the peripheral surface of the developing roller is located relatively close to the peripheral surface of the image bearing member and a second position in which the peripheral surface of the developing roller is located relatively away from the peripheral surface of the image bearing member, wherein the support unit includes a second drive input section disposed coaxially with the pivot shaft and configured to receive a rotational drive force from the drive output shaft, and a transmission mechanism configured to transmit the rotational drive force received by the second drive input section to the first drive input section, and the rotational drive force generated by the drive output shaft is for rotation in a direction of pivoting the support unit in the approaching direction.

2. An image forming apparatus according to claim 1, wherein:

the support unit includes a first engaging piece, the switching mechanism includes a lever member disposed to be movable between a first location and a second location, and a second engaging piece disposed for engagement with the first engaging piece, when the lever member is at the first location, the switching mechanism brings the first engaging piece and the second engaging piece into engagement to place the support unit into the second position, and when the lever member is at the second location, the switching mechanism brings the first engaging piece and the second engaging piece into disengagement to allow the urging force of the urging member to act on the support unit.

3. An image forming apparatus according to claim 1, wherein the support unit includes a base having an upper face and a lower face, a first side wall that stands on one edge of the base and is parallel to the developing roller, and a second side wall that stands on another edge of the base and is perpendicular to the first side wall.

4. An image forming apparatus according to claim 3, wherein the developing unit is mounted on the upper face of the base, and the urging member urges the base upward at a location on the lower face near an edge opposed to the one edge on which the first side wall stands.

5. An image forming apparatus according to claim 3, wherein the pivot shaft and the second drive input section are disposed on the first side wall, and the transmission mechanism is disposed on the second side wall.

6. An image forming apparatus according to claim 1, wherein the urging member is a coil spring.

7. An image forming apparatus according to claim 1, wherein the drive output shaft of the drive unit is a first coupling gear having gear teeth, and the second drive input section of the support unit is a second coupling gear for coupling with the first coupling gear.

8. An image forming apparatus according to claim 7, further comprising:

a pin receiver disposed on an axis of the first coupling gear; and a pin disposed on an axis of the second coupling gear and for insertion into the pin receiver.

9. An image forming apparatus according to claim 8, wherein the pin is disposed coaxially with the pivot shaft and inserted into and axially supported by the pin receiver when the first coupling gear and the second coupling gear is coupled with each other.

* * * * *